US009911429B2

(12) United States Patent
Oda et al.

(10) Patent No.: US 9,911,429 B2
(45) Date of Patent: Mar. 6, 2018

(54) NOISE REDUCTION DEVICE, NOISE REDUCTION METHOD, AND NOISE REDUCTION PROGRAM

(71) Applicant: JVC KENWOOD Corporation, Yokohama-shi, Kanagawa (JP)

(72) Inventors: Keisuke Oda, Yokohama (JP); Takaaki Yamabe, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 15/238,975

(22) Filed: Aug. 17, 2016

(65) Prior Publication Data

US 2017/0061985 A1 Mar. 2, 2017

(30) Foreign Application Priority Data

Aug. 31, 2015 (JP) ..... 2015-170231

(51) Int. Cl.

| | |
|---|---|
| ***G10L 21/02*** | (2013.01) |
| ***G10L 21/0264*** | (2013.01) |
| *G10L 21/0208* | (2013.01) |
| *G10L 25/78* | (2013.01) |

(52) U.S. Cl.

CPC ..... *G10L 21/0264* (2013.01); *G10L 25/78* (2013.01); *G10L 2021/02085* (2013.01)

(58) Field of Classification Search

None

See application file for complete search history.

(56) References Cited

U.S. PATENT DOCUMENTS

| | | | | |
|---|---|---|---|---|
| 5,903,819 | A * | 5/1999 | Romesburg | G10K 11/1788 375/285 |
| 7,016,507 | B1 * | 3/2006 | Brennan | H04R 3/00 381/23.1 |
| 8,971,549 | B2 * | 3/2015 | Sekiya | G10L 21/0208 381/94.3 |
| 9,379,854 | B2 * | 6/2016 | Hamzeh | H04L 1/20 |
| 2002/0184018 | A1 * | 12/2002 | Kondo | G10L 19/18 704/237 |

(Continued)

FOREIGN PATENT DOCUMENTS

| | | |
|---|---|---|
| JP | 2003-58186 A | 2/2003 |
| JP | 2012-128411 A | 7/2012 |

*Primary Examiner* — Satwant Singh

(74) *Attorney, Agent, or Firm* — Nath, Goldberg & Meyer; Jerald L. Meyer; Stanley N. Protigal

(57) ABSTRACT

A frame generator 3 frames an input signal and generates a frame signal. A reference signal storage unit 7 stores therein a reference signal showing a periodic noise signal. A correlation value calculator 8 calculates a correlation value between the frame signal and the reference signal. A correlation candidate position decider 9 decides a plurality of correlation candidate positions serving as candidates for a signal portion of the reference signal correlated with the frame signal. A noise reduction processor 10 reduces a periodic noise signal, which is included in the frame signal, by using each signal portion of the plurality of correlation candidate positions, and generates a plurality of candidate output signals. An output signal decider 11 decides a candidate output signal, in which the periodic noise signal is reduced the most among the plurality of candidate output signals, and outputs the decided output signal.

6 Claims, 9 Drawing Sheets

(56) References Cited

U.S. PATENT DOCUMENTS

| | | | | |
|---|---|---|---|---|
| 2002/0196876 | A1* | 12/2002 | Takada | H04B 1/7101 375/346 |
| 2005/0171769 | A1* | 8/2005 | Naka | G10L 25/78 704/214 |
| 2008/0010063 | A1* | 1/2008 | Komamura | G10L 21/0208 704/226 |
| 2008/0015853 | A1* | 1/2008 | Honda | G10L 25/78 704/228 |
| 2011/0301945 | A1* | 12/2011 | Ichikawa | G10L 15/20 704/211 |
| 2016/0379663 | A1* | 12/2016 | Oda | G10L 21/0232 381/94.2 |

* cited by examiner

NOISE REDUCTION DEVICE, NOISE REDUCTION METHOD, AND NOISE REDUCTION PROGRAM

CROSS REFERENCE TO RELATED APPLICATION

This application is based upon and claims the benefit of priority under 35 U.S.C. § 119 from Japanese Patent Application No. 2015-170231 filed on Aug. 31, 2015, the entire contents of which are incorporated herein by reference.

BACKGROUND

The present disclosure relates to a noise reduction device, a noise reduction method, and a noise reduction program, which reduce a periodic noise signal of an input signal in which a voice signal and the periodic noise signal are mixed with each other.

For example, in an event where a firefighter goes into action to a fire site or an event where a firefighter performs firefighting, the firefighter sometimes uses a radio. When the firefighter speaks to other firefighter or a member at headquarters by using the radio, sometimes a siren sound that is a periodic noise is mixed with the voice.

In this case, a signal in which a voice signal and a periodic noise signal are mixed with each other is transmitted from a transmitting radio to a receiving radio. Hence, in some cases, the firefighter or the member who has the receiving radio cannot catch the voice sufficiently.

SUMMARY

Japanese Unexamined Patent Application Publication No. 2003-58186 (Patent Document 1) describes a noise reduction device that reduces the periodic noise signal from such an input signal in which the voice signal and the periodic noise signal are mixed with each other. The noise reduction device described in Patent Document 1 converts the input signal into a signal within a frequency range, detects the periodic noise, and suppresses the periodic noise signal.

In the case of periodic noise in which the speed of frequency change is relatively slow, the periodic noise signal can be reduced by a method of converting the input signal into the signal within the frequency range, which is described in Patent Document 1. However, in the case of periodic noise in which the speed of frequency change is relatively fast, the periodic noise signal cannot be reduced by the method of converting the input signal into the signal within the frequency range, which is described in Patent Document 1.

In this connection, a noise reduction device, a noise reduction method, and a noise reduction program are desired, which are capable of reducing the periodic noise signal, even when the periodic noise signal is of such periodic noise in which the speed of frequency change is relatively fast.

A first aspect of the embodiments provides a noise reduction device including: a frame generator configured to frame an input signal per predetermined number of samples, and to sequentially generate frame signals; a reference signal storage unit configured to store therein a reference signal having a time length longer than a time length of each of the frame signals, the reference signal showing a periodic noise signal mixed with the input signal; a correlation value calculator configured to calculate correlation values between the frame signals and the reference signal; a correlation candidate position decider configured to select a plurality of locations in which the correlation values are relatively high, and to decide a plurality of correlation candidate positions serving as candidates for a signal portion of the reference signal correlated with the frame signals; a noise reduction processor configured to perform processing to reduce the periodic noise signal, which is included in the frame signal, by using each signal portion of the plurality of correlation candidate positions, and to generate a plurality of candidate output signals which are candidates for an output signal subjected to noise reduction processing; and an output signal decider configured to decide a candidate output signal, in which the periodic noise signal is reduced the most among the plurality of candidate output signals, as the output signal, and to output the decided output signal.

A second aspect of the embodiments provides a noise reduction method including: framing an input signal per predetermined number of samples and sequentially generating frame signals; calculating correlation values between the frame signals and a reference signal having a time length longer than a time length of each of the frame signals, the reference signal showing a periodic noise signal mixed with the input signal; selecting a plurality of locations in which the correlation values are relatively high, and deciding a plurality of correlation candidate positions serving as candidates for a signal portion of the reference signal correlated with the frame signals; performing processing to reduce the periodic noise signal, which is included in the frame signal, by using each signal portion of the plurality of correlation candidate positions, and generating a plurality of candidate output signals which are candidates for an output signal subjected to noise reduction processing; and selecting a candidate output signal, in which the periodic noise signal is reduced the most among the plurality of candidate output signals, as the output signal.

A third aspect of the embodiments provides a noise reduction program that is stored in a non-transitory recording medium and allows a computer to execute: a step of framing an input signal per predetermined number of samples and sequentially generating frame signals; a step of calculating correlation values between the frame signals and a reference signal having a time length longer than a time length of each of the frame signals, the reference signal showing a periodic noise signal mixed with the input signal; a step of selecting a plurality of locations in which the correlation values are relatively high, and deciding a plurality of correlation candidate positions serving as candidates for a signal portion of the reference signal correlated with the frame signals; a step of performing processing to reduce the periodic noise signal, which is included in the frame signal, by using each signal portion of the plurality of correlation candidate positions, and generating a plurality of candidate output signals which are candidates for an output signal subjected to noise reduction processing; and a step of selecting a candidate output signal, in which the periodic noise signal is reduced the most among the plurality of candidate output signals, as the output signal.

DETAILED DESCRIPTION

A description is made below of a noise reduction device, a noise reduction method, and a noise reduction program according to the embodiment, with reference to the accompanying drawings.

Figure 1:
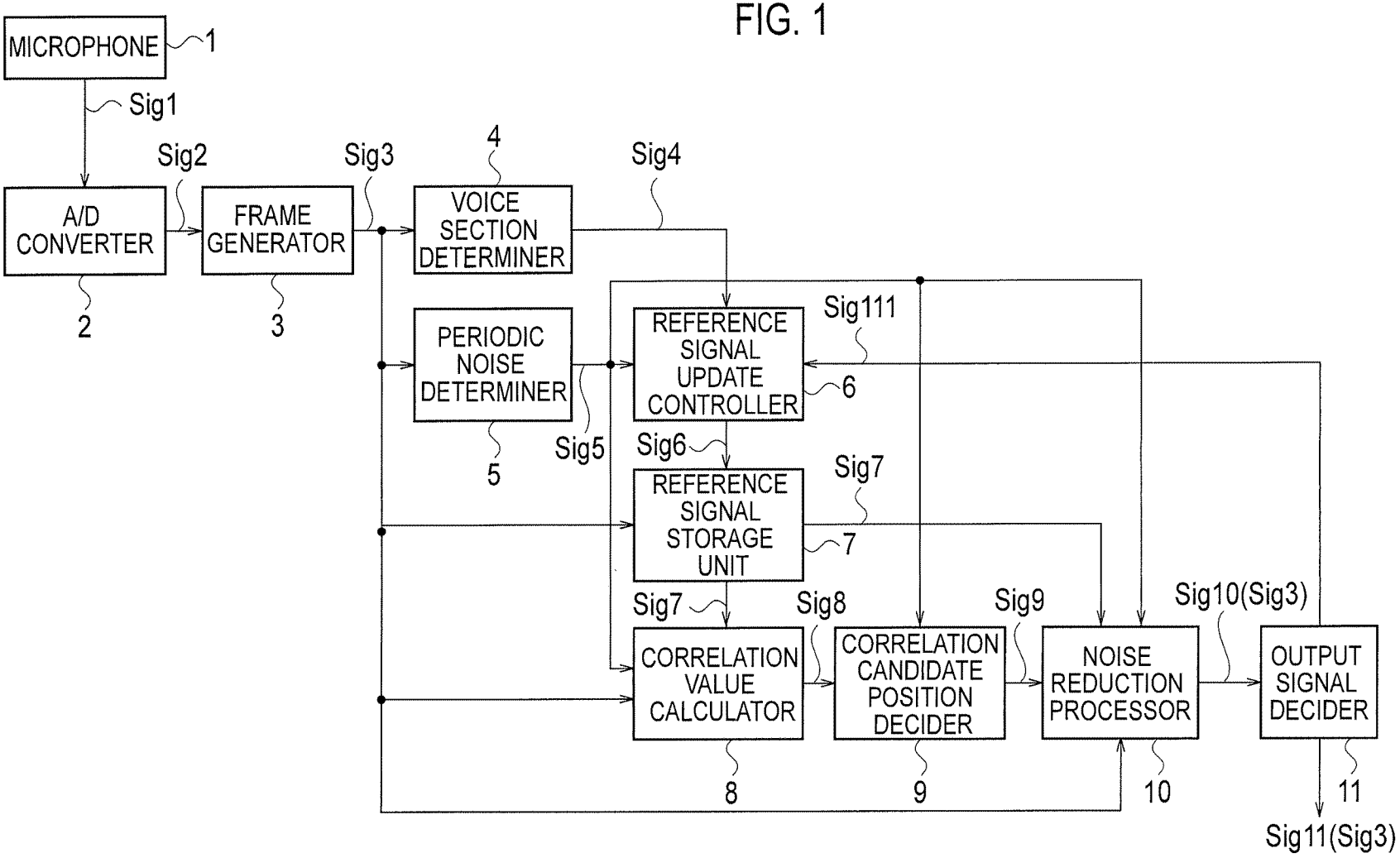
FIG. 1 is a block diagram showing a noise reduction device according to at least one embodiment.

In FIG. 1, a microphone 1 collects a sound on a periphery thereof. The microphone 1 may be provided in the housing of an electronic instrument such as a radio, or it may be mounted as a separate body from the electronic instrument on the electronic instrument. The sound collected by the microphone 1 is sometimes a sound in which a periodic noise such as a siren sound is mixed with a voice.

The microphone 1 supplies an analog signal Sig1, which is obtained by converting the collected sound into an electrical signal to an A/D converter 2.

The A/D converter 2 converts the analog signal Sig1, which is inputted thereto into a digital signal. In the case where an A/D converter is mounted on the microphone 1, and the microphone 1 outputs a digital signal, the A/D converter 2 is unnecessary. The digital signal, which is supplied from the A/D converter 2 (or the microphone 1) to a frame generator 3, is an input signal Sig2 processed by the noise reduction device.

Figure 2:
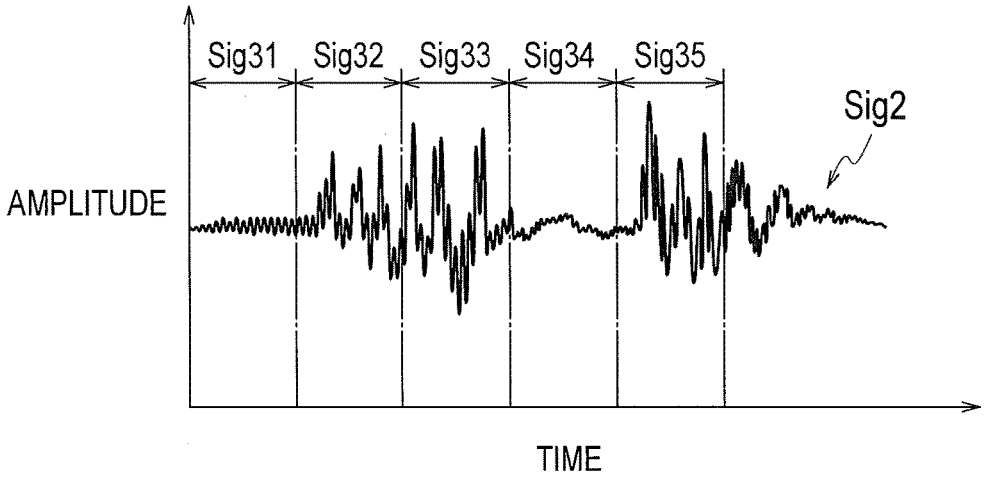
FIG. 2 is a waveform chart for explaining the framing of an input signal.

FIG. 2 shows a state where the amplitude of the input signal Sig2 is changed with the progress of time. As shown in FIG. 2, the frame generator 3 frames the input signal Sig2 per predetermined number of samples (that is, every predetermined time), and sequentially generates frame signals Sig31, Sig32, Sig33 . . . . The frame signals Sig31, Sig32, Sig33 . . . are collectively referred to as frame signals Sig3.

In the case where a sampling frequency of the input signal Sig2 is relatively low, in some cases, a later-described correlation value cannot be calculated accurately if the number of samples is small. In order to calculate the correlation value accurately and to reduce the periodic noise, a time length of the frame signals Sig3 is set to 0.03 to 0.04 seconds, for example. The time length (number of samples) of the frame signals Sig3 needs to be set as appropriate in response to a condition such as the sampling frequency of the input signal Sig2.

The frame signals Sig3 are supplied to a voice section determiner 4, a periodic noise determiner 5, a reference signal storage unit 7, a correlation value calculator 8, and a noise reduction processor 10.

The voice section determiner 4 determines whether or not each of the frame signals Sig3 inputted thereto is a voice section including a voice. The voice section determiner 4 may determine whether or not the frame signal Sig3 is the voice section per frame, or may determine that the frame signal Sig3 is a voice section in a case where the frame signals Sig3 including the voice continue by the predetermined number of frames. For example, the voice section determiner 4 can determine whether or not the frame signal Sig3 includes a voice based on whether or not the frame signal Sig3 includes a signal with a frequency band of the human voice. The voice section determiner 4 may determine the voice section by a determination method of a voice section, which is described in Japanese Unexamined Patent Application Publication No. 2012-128411.

The voice section determiner 4 supplies voice section determination information Sig4 to a reference signal update controller 6, which indicates whether or not the frame signal Sig3 is a voice section.

Figure 3:
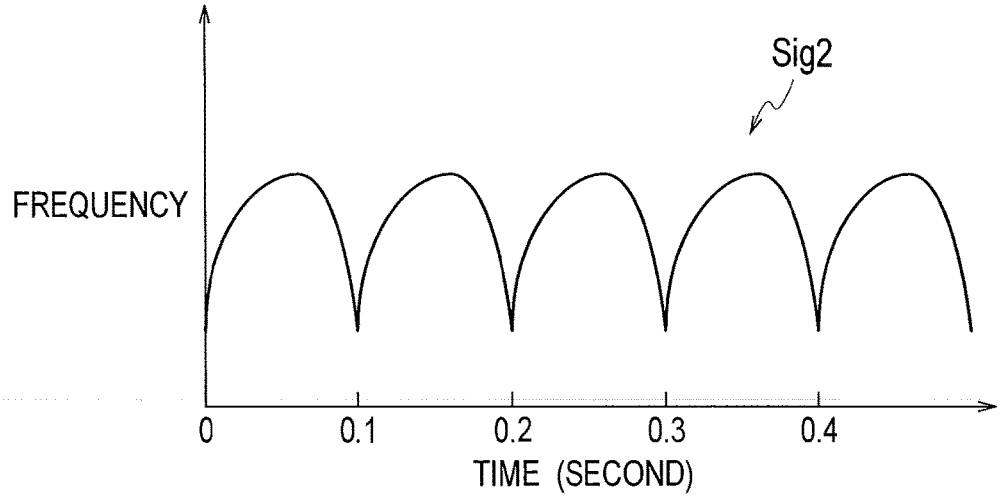
FIG. 3 is a characteristic diagram showing an example as to how a frequency of the input signal is changed with the progress of time.

When the input signal Sig2 includes the periodic noise signal, the frequency of the input signal Sig2 is changed, as is schematically shown in FIG. 3 as an example. In the embodiment, it is defined that the periodic noise signal, which is mixed with a voice signal and taken as a reduction target, is a periodic noise signal in which such a frequency change is relatively fast, as shown in FIG. 3.

The periodic noise determiner 5 determines whether or not each of the frame signals Sig3 inputted thereto includes the periodic noise signal. The periodic noise determiner 5 needs only to determine whether or not the frame signal Sig3 includes the periodic noise signal. An example is described as follows.

The periodic noise determiner 5 stores a plurality of the past frame signals Sig3. The periodic noise determiner 5 calculates correlation values between the newest frame signal Sig3 and the plurality of past frame signals Sig3. When the frame signal Sig3 includes the periodic noise signal, peaks appear periodically in a correlation value signal. The periodic noise determiner 5 determines that the frame signal Sig3 includes the periodic noise signal when the correlation value signal includes such periodic peaks.

It is recommended that the time length of the plurality of past frame signals Sig3 should be set to a time longer than the sum of the time length of the newest frame signal Sig3, and the cycle of the periodic noise. Moreover, it is recommended that the time length of the plurality of past frame signals Sig3 should be a time length shorter than twice the cycle of the periodic noise, and for example, needs only to be set to a time length of approximately 1.5 cycles.

The periodic noise determiner 5 supplies noise determination information Sig5, which indicates whether or not the frame signal Sig3 includes the periodic noise signal to the reference signal update controller 6, the correlation value calculator 8, the correlation candidate position decider 9, and the noise reduction processor 10.

The reference signal update controller 6 determines whether or not to allow the reference signal storage unit 7 to store the reference signal Sig7 therein, based on the voice section determination information Sig4, and the noise determination information Sig5. In the case where the reference signal Sig7 is already stored in the reference signal storage unit 7, the reference signal update controller 6 determines whether or not to update the reference signal Sig7, based on the voice section determination information Sig4 and the noise determination information Sig5.

The reference signal Sig7, stored in the reference signal storage unit 7, is used for removing the periodic noise from the frame signal Sig3. Hence, it is recommended that the reference signal Sig7 should not include the voice signal, but should include only the periodic noise signal.

Accordingly, when the voice section determination information Sig4 indicates that the frame signal Sig3 is not the voice section and the noise determination information Sig5 indicates that the frame signal Sig3 includes the periodic noise signal, then the reference signal update controller 6 allows the reference signal storage unit 7 to store the reference signal Sig7 therein, or generates a control signal Sig6 for updating the reference signal Sig7.

It is recommended that the reference signal Sig7 should be generated based on the past frame signal Sig3 that does not include the newest frame signal Sig3. To the reference signal update controller 6, timing information Sig111 is inputted that indicates timing when the output signal decider 11 outputs an output signal.

Based on the timing information Sig111, the reference signal update controller 6 supplies the control signal Sig6 to the reference signal storage unit 7, so as to allow the reference signal storage unit 7 to store therein the past frame signal Sig3, which does not include the newest frame signal Sig3, as the reference signal Sig7.

The reference signal storage unit 7 temporarily stores the plurality of frame signals Sig3, while cyclically updating the same frame signals Sig 3. If the reference signal Sig7 is not stored therein when the control signal Sig6 is inputted thereto from the reference signal update controller 6, the reference signal storage unit 7 stops such cyclic and temporal storage, and holds the plurality of past frame signals Sig3 as the reference signal Sig7.

If the reference signal Sig7 is already stored therein when the control signal Sig6 is inputted thereto from the reference signal update controller 6, the reference signal storage unit 7 stops the cyclic and temporal storage, and updates the reference signal Sig7 by overwriting the same with a new reference signal Sig7.

The reference signal Sig7 is a signal having a time length of at least one cycle of the periodic noise signal. It is recommended that the reference signal Sig7 should set to be a signal having a time length exceeding one cycle of the periodic noise signal.

Figure 4A:
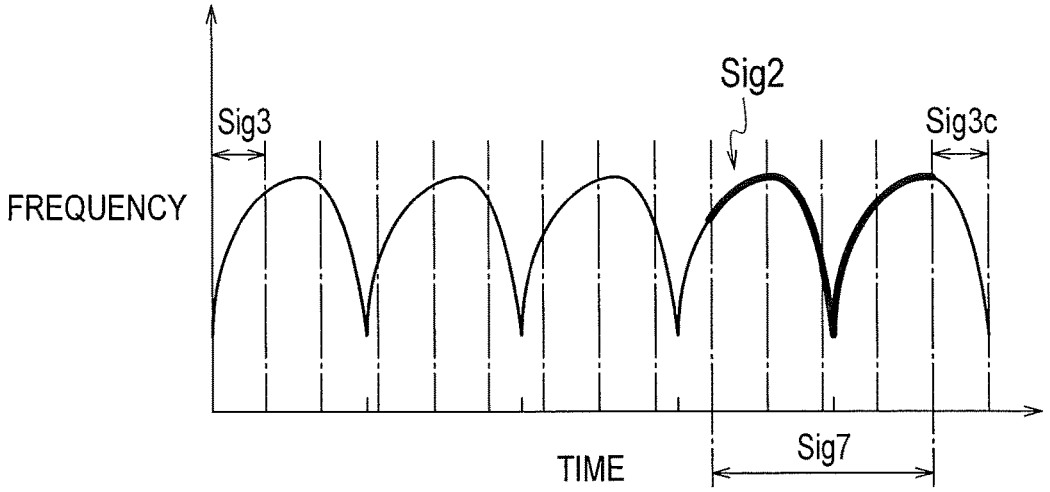
FIG. 4A is a characteristic diagram showing the relationship between a frame signal and a reference signal, and showing a case where a signal portion immediately before the newest signal is used as the reference signal.
Figure 4B:
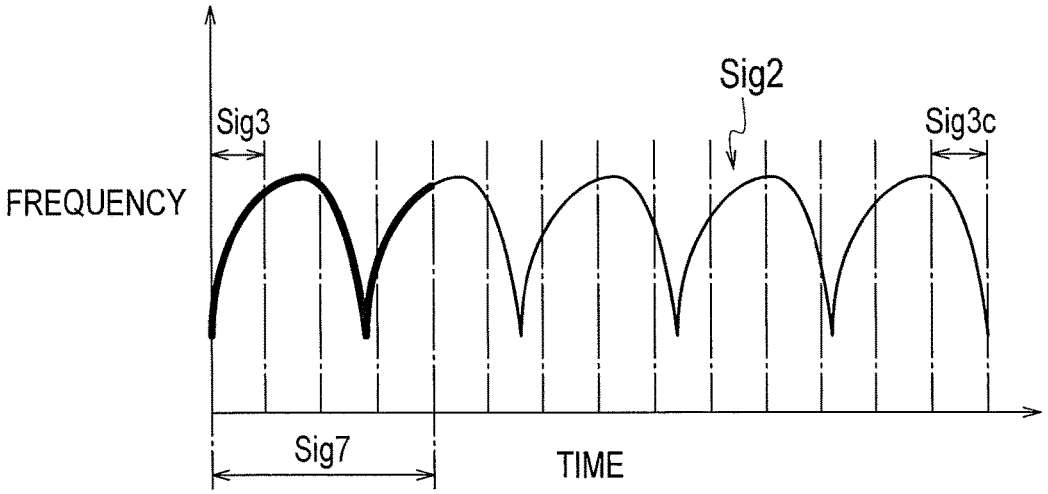
FIG. 4B is a characteristic diagram showing the relationship between a frame signal and a reference signal, and showing a case where a signal portion from the past from the signal portion immediately before the newest signal is used as the reference signal.

In FIG. 4A and FIG. 4B, the frame signal Sig3*c* is the newest frame signal Sig3, and a signal portion shown by a bold solid line in the input signal Sig2 is the reference signal Sig7.

In an example shown in FIG. 4A, the signal portion immediately before the newest frame signal Sig3*c* is used as the reference signal Sig7. In an example shown in FIG. 4B, a past signal portion from the signal portion immediately before the newest frame signal Sig3*c* is used as the reference signal Sig7.

As shown in FIG. 4A and FIG. 4B, the reference signal Sig7 is set to have a time length of approximately 1.5 cycles of the periodic noise signal, for example.

If the voice section determination information Sig4 indicates that the frame signal Sig3 is not a voice section and the noise determination information Sig5 indicates that the frame signal Sig3 includes a periodic noise signal, then the reference signal Sig7 is updated. Hence, as shown in FIG. 4A, the signal portion immediately before the newest frame signal Sig3*c* is stored and is used as the reference signal Sig7 in the reference signal storage unit 7.

If the voice section determination information Sig4 indicates that the frame signal Sig3 is the voice section and the noise determination information Sig5 indicates that the frame signal Sig3 does not include the periodic noise signal, then the reference signal Sig7 stored in the reference signal storage unit 7 is not updated. Hence, as shown in FIG. 4B, the past signal portion is used continuously as the reference signal Sig7.

Incidentally, it is desired that only the periodic noise signal should be stored as the reference signal Sig7 in the reference signal storage unit 7. However, in actuality, a variety of noises such as road noise and an engine sound are sometimes mixed with the periodic noise. Hence, the periodic noise signal sometimes includes additional noise components.

As seen from the above description, the reference signal storage unit 7 includes: a storage region that temporarily stores the plurality of frame signals Sig3 in order to generate the reference signal Sig7, and a storage region that stores the generated reference signal Sig7 so as to hold the same reference signal Sig7. The former storage region and the latter storage region may be provided in separate memories.

In the above-mentioned determination operation as to whether or not the periodic noise signal is included, which is performed by the periodic noise determiner 5, the reference signal storage unit 7 may store the plurality of past frame signals Sig3 in place of the periodic noise determiner 5. The periodic noise determiner 5 may determine whether or not the periodic noise signal is included by using the plurality of frame signals Sig3 stored in the reference signal storage unit 7, in order to generate the reference signal Sig7.

The reference signal Sig7 stored by the reference signal storage unit 7 is supplied to the correlation value calculator 8 and the noise reduction processor 10.

When the noise determination information Sig5 indicates that the frame signal Sig3 includes the periodic noise signal, the correlation value calculator 8 calculates a correlation value A[m] between the frame signal Sig3 and the reference signal Sig7, which are inputted thereto based on Equation (1), for example.

In Equation (1), x denotes the reference signal Sig7, y denotes the frame signal Sig3, m denotes a phase shift amount that indicates the position of a peak in a correlation value signal Sig8, t denotes the sample position of the frame signal Sig3, and n indicates the number of samples of the frame signal Sig3.

$$A[m] = \sum_{t=0}^{n-1} (x[t+m] \times y[t]) \tag{1}$$

In the case where the correlation value A[m] is calculated in the whole range of the reference signal Sig7, the range of the phase shift amount m is represented as: $0 \leq m < (N-n)$, where N is the number of samples of the reference signal Sig7.

The correlation value calculator 8 supplies the correlation value signal Sig8, which indicates the calculated correlation value A[m] to the correlation candidate position decider 9.

Figure 5A:
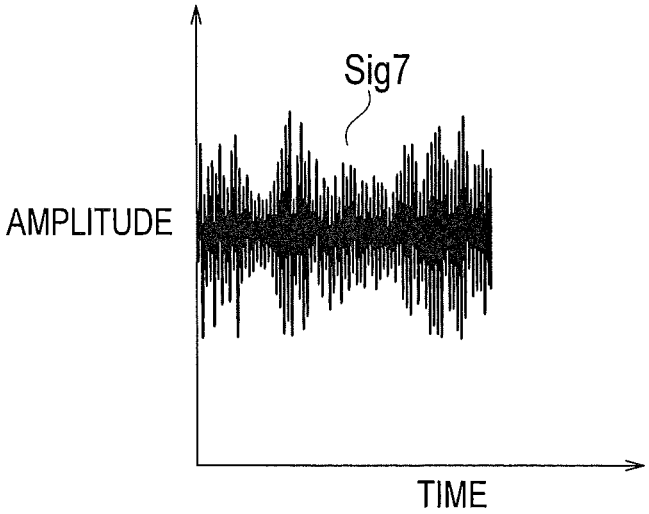
FIG. 5A is the first example of the specific operations of a correlation value calculator 8 and the correlation candidate position decider 9 as shown in FIG. 1, and is a waveform chart showing a reference signal with which a noise component is not mixed.
Figure 5B:
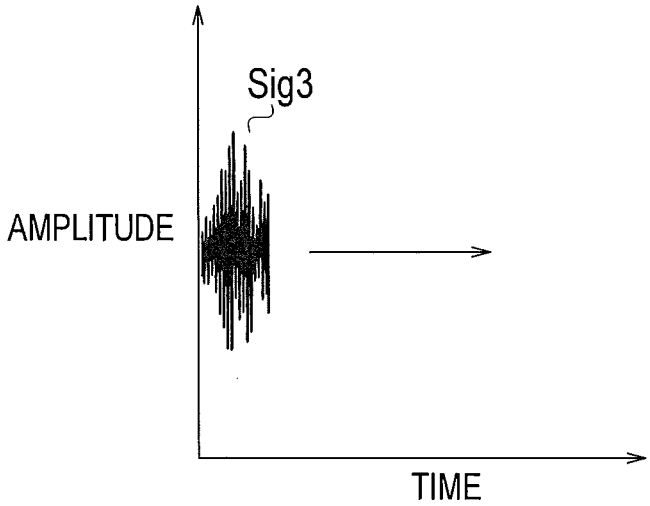
FIG. 5B is the first example of the specific operations of the correlation value calculator 8 and the correlation candidate position decider 9 as shown in FIG. 1, and is a waveform chart for explaining a calculation operation of a correlation value by the correlation value calculator 8.
Figure 5C:
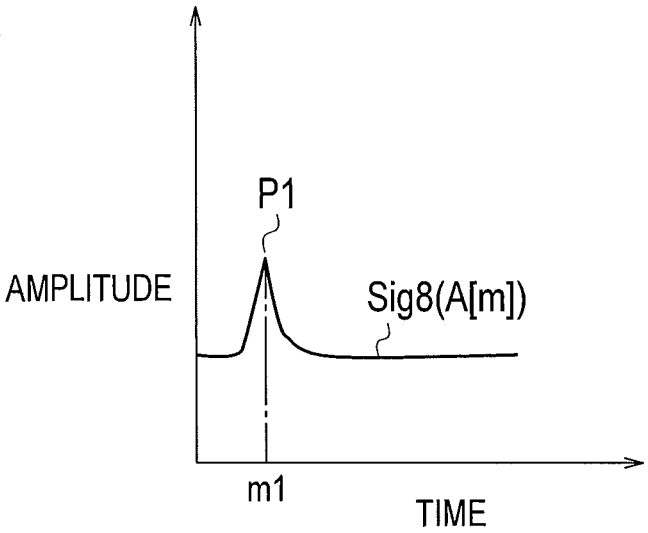
FIG. 5C is the first example of the specific operations of the correlation value calculator 8 and the correlation candidate position decider 9 as shown in FIG. 1, and is a waveform chart showing the correlation value calculated by the correlation value calculator 8.
Figure 6A:
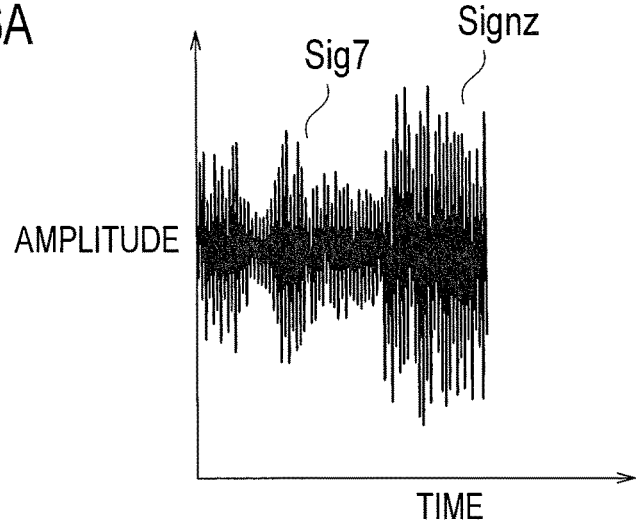
FIG. 6A is the second example of the operations of the correlation value calculator 8 and the correlation candidate position decider 9 as shown in FIG. 1, and is a waveform chart showing a reference signal with which the noise component is not mixed.
Figure 6B:
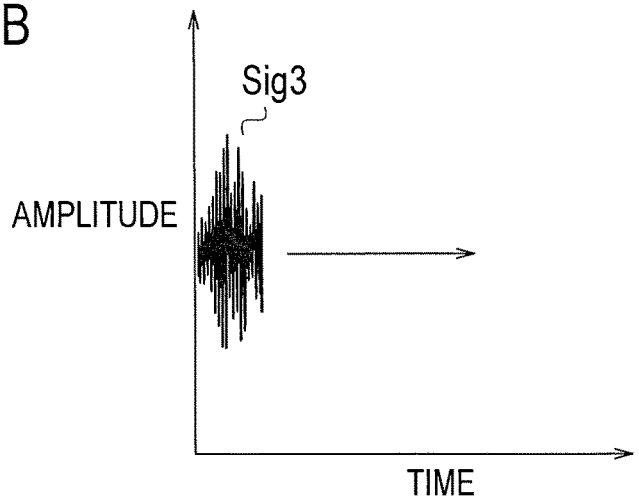
FIG. 6B is the second example of the operations of the correlation value calculator 8 and the correlation candidate position decider 9 as shown in FIG. 1, and is a waveform chart for explaining a calculation operation of the correlation value by the correlation value calculator 8.
Figure 6C:
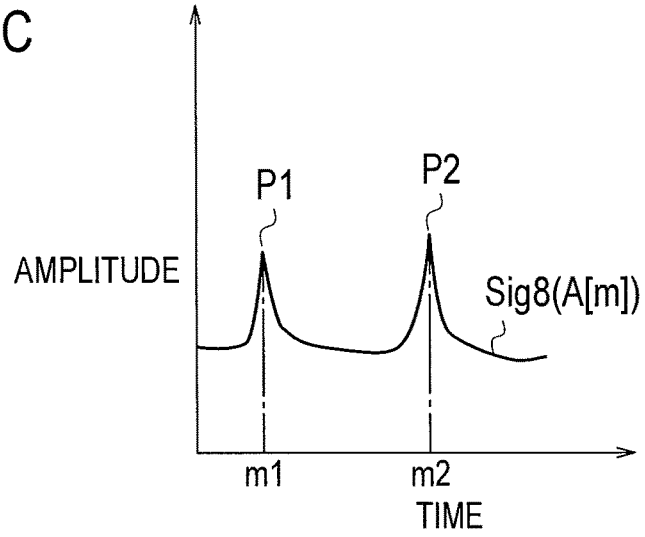
FIG. 6C is the second example of the operations of the correlation value calculator 8 and the correlation candidate position decider 9 as shown in FIG. 1, and is a waveform chart showing the correlation value calculated by the correlation value calculator 8.

By using FIG. 5A to FIG. 5C and FIG. 6A to FIG. 6C, a specific description is made of the operations of the correlation value calculator 8 and the correlation candidate position decider 9. FIG. 5A to FIG. 5C show the operations of the correlation value calculator 8 and the correlation candidate position decider 9 in the case where additional noise components are not mixed with the reference signal Sig7, and FIG. 6A to FIG. 6C show the operations of the correlation value calculator 8 and the correlation candidate position decider 9 in the case where additional noise components are mixed with the reference signal Sig7.

FIG. 5A shows the state where the amplitude of the reference signal Sig7 is changed with the progress of time. Here, the additional noise components are not mixed. FIG. 5B shows the newest frame signal Sig3 inputted to the correlation value calculator 8.

As shown by an arrow in FIG. 5B, while phase-shifting the frame signal Sig3 one sample at a time, the correlation value calculator 8 calculates the correlation value A[m] between the frame signal Sig3 and the reference signal Sig7. Then, the correlation value A[m] is changed as shown in FIG. 5C with the progress of time, and the correlation value signal Sig8 exhibits a peak P1.

The correlation value signal Sig8 shown in FIG. 5C is supplied to the correlation candidate position decider 9. The correlation candidate position decider 9 detects the position of the peak in the correlation value signal Sig8, and decides the position of the peak as a correlation candidate position serving as a candidate for the signal portion of the reference signal Sig7, correlated with the frame signal Sig3. When the noise determination information Sig5 indicates that the frame signal Sig3 includes the periodic noise signal, the correlation candidate position decider 9 executes an operation of deciding the correlation candidate position.

Here, the peak in the correlation value signal Sig8 is only one that is the peak P1. The position of the peak P1 which is indicated at m1 illustrates the phase shift amount in which the frame signal Sig3, shown in FIG. 5B, gains the highest correlation value A[m] with the reference signal Sig7, shown in FIG. 5A.

That is, when the frame signal Sig3 is phase-shifted by the number of samples which is equivalent to the phase shift amount m1, then the frame signal Sig3 is phase-shifted to become the signal portion of the reference signal Sig7, which is correlated most with the frame signal Sig3.

The reference signal Sig7, shown in FIG. 6A, includes the noise component Signz. In a similar way, as shown by an arrow in FIG. 6B, while phase-shifting the frame signal Sig3 one sample at a time, the correlation value calculator 8 calculates the correlation value A[m] between the frame signal Sig3 and the reference signal Sig7.

Then, the correlation value A[m] is changed with the progress of time, as shown in FIG. 6C. Since the reference signal Sig7 includes the noise component Signz, the correlation value signal Sig8 sometimes exhibits the two peaks P1 and P2, as shown in FIG. 6C.

The correlation candidate position decider 9 detects the positions of the peaks P1 and P2 in the correlation value signal Sig8, and decides the positions of the peaks P1 and P2 as a plurality of correlation candidate positions, serving as candidates for the signal portion of the reference signal Sig7, correlated with the frame signal Sig3.

The position of the peak P1, which is indicated at m1, illustrates the phase shift amount m1 in which the frame signal Sig3, shown in FIG. 6B, gains a highest correlation value A[m], with the reference signal Sig7 shown in FIG. 6A.

The peak P2 is one which is accidentally generated by the fact that the reference signal Sig7 includes the noise component Signz. The position of the peak P2, which is indicated at m2, does not illustrate the phase shift amount m2, in which the frame signal Sig3 gains the highest correlation value A[m], with the reference signal Sig7.

As described above, when the correlation value calculator 8 calculates the correlation value A[m] between the frame signal Sig3 and the reference signal Sig7, the correlation value signal Sig8 sometimes exhibits a plurality of the peaks, owing to an influence of the noise component Signz or the like.

Based on the correlation value signal Sig8, the correlation candidate position decider 9 selects a plurality of locations in each of which the correlation value A[m] is relatively high, and decides a plurality of the correlation candidate positions serving as candidates for the signal portion of the reference signal Sig7, correlated with the frame signal Sig3.

The correlation candidate position decider 9 needs only to smooth and differentiate the correlation value A[m], and to detect zero crossing points which represent the peaks at which a differential value turns from positive to negative, or needs only to detect a plurality of locations which represent the peaks in each of which the correlation value A[m] is higher. A method by which the correlation candidate position decider 9 detects the positions of the peaks is arbitrary.

The correlation candidate position decider 9 supplies the position information Sig9, which indicates each of the plurality of correlation candidate positions to the noise reduction processor 10. The correlation candidate position decider 9 can define the phase shift amounts m1 and m2, which are shown in FIG. 6C, as the position information Sig9.

When the noise determination information Sig5 indicates that the frame signal Sig3 includes the periodic noise signal, the noise reduction processor 10 performs processing so as to reduce the periodic noise signal, which is included in the frame signal Sig3, by using the signal portion at each of the plurality of correlation candidate positions in the reference signal Sig7.

Specifically, based on Equation (2), the noise reduction processor 10 needs only to add an antiphase signal to each of the signal portions at the correlation candidate positions in the reference signal Sig7 to the frame signal Sig3, and to generate an addition signal B[t].

$$B[t]=-x[m+t]+y[t] \tag{2}$$

As seen from Equation (2), the noise reduction processor 10 defines the starting position which is obtained by phase-shifting the frame signal Sig3 by the phase shift amount m, and adds an antiphase signal to the signal portion of the reference signal Sig7 to the frame signal Sig3, which is equivalent to the number of samples of the frame signal Sig3.

In such a second example of FIG. 6A to FIG. 6C, correlation value signal Sig8 exhibits the two peaks P1 and P2, and accordingly, the noise reduction processor 10 generates the addition signal B1[*t*], in which m1 is assigned to m, and the addition signal B2[*t*], in which m2 is assigned to m.

The noise reduction processor 10 generates the plurality of candidate output signals Sig10 subjected to noise reduction processing, and supplies the generated candidate output signals Sig10 to the output signal decider 11. In the second example of FIG. 6A to FIG. 6C, the candidate output signal Sig10 is the addition signals B1[*t*] and B2[*t*].

Figure 7A:
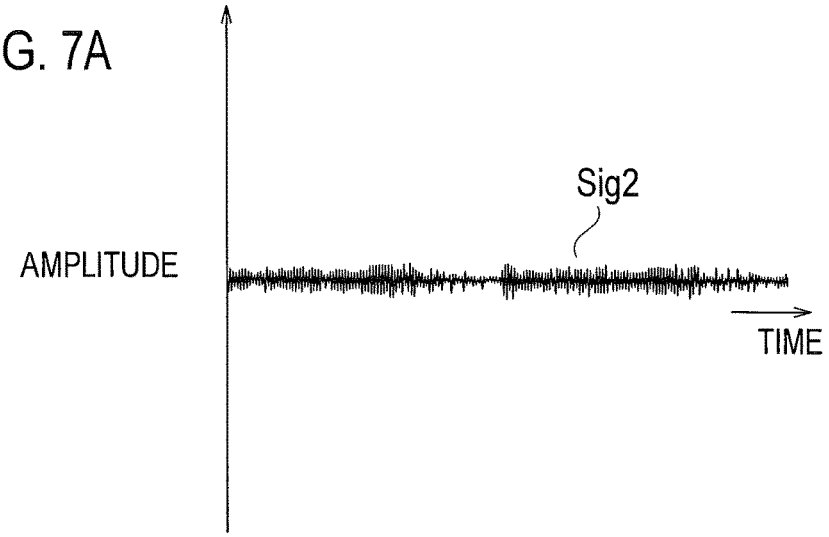
FIG. 7A is a waveform chart showing an input signal including a periodic noise signal; the waveform chart serving for explaining an operation of the output signal decider 11 as shown in FIG. 1.
Figure 7B:
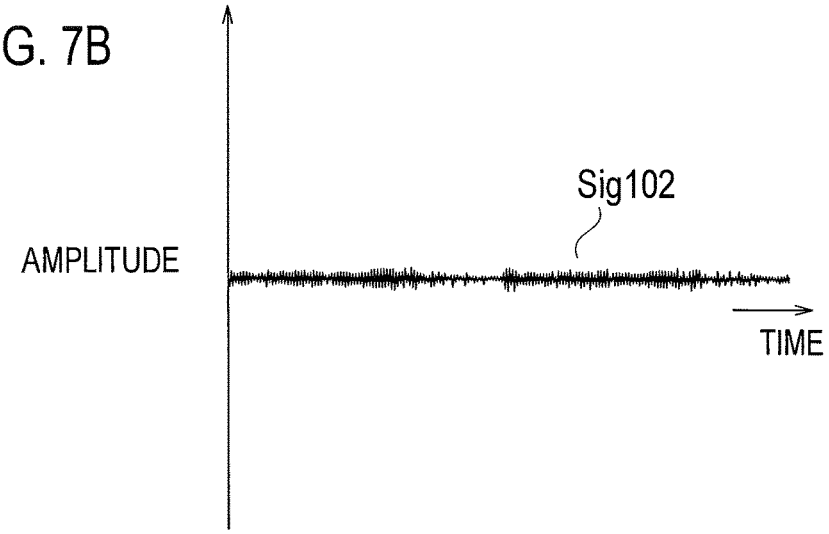
FIG. 7B is a waveform chart showing one candidate output signal; the waveform chart serving for explaining the operation of the output signal decider 11 as shown in FIG. 1.

FIG. 7A shows the input signal Sig2, including the periodic noise signal. FIG. 7B shows a candidate output signal Sig102 that is one of such candidate output signals Sig10. The candidate output signal Sig102 corresponds to the addition signal B2[*t*].

That is, the candidate output signal Sig102 shows a signal waveform in the case where, in each frame signal Sig3, processing is performed so as to reduce the periodic noise signal in the signal portion of the reference signal Sig7, which is not appropriately correlated with the frame signal Sig3.

Figure 7C:
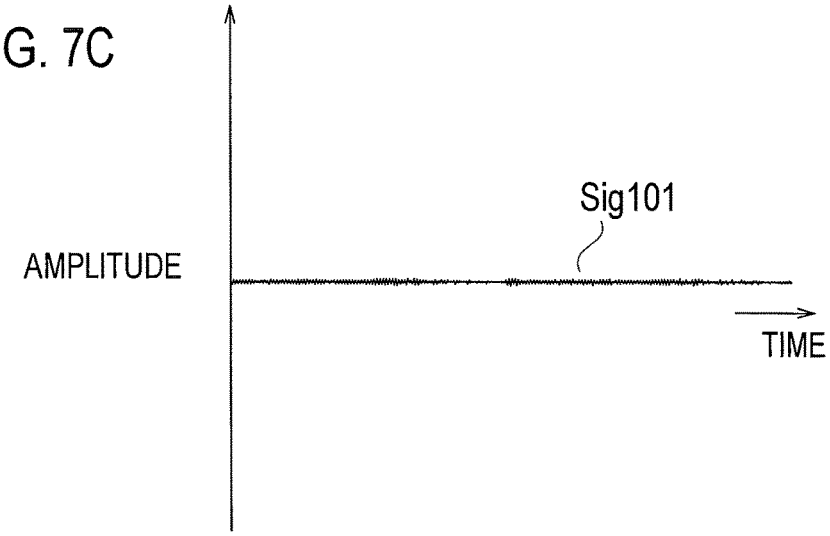
FIG. 7C is a waveform chart showing another candidate output signal; the waveform chart serving for explaining the operation of the output signal decider 11 as shown in FIG. 1.

FIG. 7C shows a candidate output signal Sig101, that is another of the candidate output signals Sig10. The candidate output signal Sig101 corresponds to the addition signal B1[*t*].

That is, the candidate output signal Sig101 shows a signal waveform in a case where, in each frame signal Sig3, processing is performed so as to reduce the periodic noise signal in the signal portion of the reference signal Sig7, which is appropriately correlated with the frame signal Sig3.

From among the plurality of candidate output signals Sig10 (Sig101 and Sig102), the output signal decider 11 decides the candidate output signal Sig10 (Sig101) in which the periodic noise signal is reduced the most, as an output signal Sig11, and outputs the output signal Sig11.

The output signal decider 11 needs only to select the candidate output signal Sig10 in which the periodic noise signal is reduced the most, in such a manner as follows.

For example, based on Equation (3), the output signal decider 11 generates the square sum signal C of the respective candidate output signals Sig10.

$$C=\sum_{t=0}^{n-1}(B[t]\times B[t]) \tag{3}$$

In Equation (3), B[t] is the above-described addition signal B1[*t*] or B2[*t*]. The square sum signal C, when B[t] is the addition signal B1[*t*], is defined as C1, and the square sum signal C, when B [t] is the addition signal B2 [t], is defined as C2.

The output signal decider 11 can determine that a smaller one between the square sum signals C1 and C2 is the candidate output signal Sig10, in which the periodic noise signal is reduced more.

In place of selecting the candidate output signal Sig10 in which the square sum signal C is the smallest, the output signal decider 11 may select a candidate output signal Sig10 in which a value indicating variations of the amplitude is the smallest. As the value indicating the variations of the amplitude, for example, there can be used a variance of the amplitude, a difference or a ratio between the maximum value of the amplitude and the minimum value thereof, or a difference or a ratio between an average value of the amplitude and a median thereof.

The output signal decider 11 may select the candidate output signal Sig10 by using both the square sum signal C and the value indicating the variance of the amplitude.

In this case, the output signal decider 11 first compares the respective square sum signals C of the plurality of candidate output signals Sig10 with one another, and selects the candidate output signal Sig10 in which the square sum signal C is the smallest, in the case where there are sufficient differences among the square sum signals C. In the case where the respective square sum signals C are approximate to one another, the output signal decider 11 selects the candidate output signal Sig10 in which the value indicating the variance of the amplitude is the smallest.

As described above, at the time of selecting anyone from among the plurality of candidate output signals Sig10, preferably, the output signal decider 11 selects such a candidate output signal Sig10 based on a comparison result of the square sum signals C. In the case where there is a high possibility that an erroneous determination may occur if the candidate output signal Sig10 is selected by the comparison among only the square sum signals C, then it is recommended that the output signal decider 11 should select the candidate output signal Sig10, in consideration of other signal characteristics such as the value indicating the variance of the amplitude.

Note that in the case where the frame signal Sig3 does not include the periodic noise signal, the correlation value calculator 8 and the correlation candidate position decider 9 do not operate. The noise reduction processor 10 needs only to directly supply the frame signal Sig3, which is inputted thereto to the output signal decider 11, and the output signal decider 11 needs only to directly output the frame signal Sig3 which is inputted thereto.

In the configuration shown in FIG. 1, each of the constituent elements ranging from the A/D converter 2 to the output signal decider 11 may be composed of hardware such as a circuit, or may be composed of software (a computer program).

In the constituent elements of the noise reduction device, the hardware and the software may be mixed. The choice of the hardware and the software is arbitrary.

For example, among the constituent elements ranging from the frame generator 3 to the output signal decider 11, portions excluding the reference signal storage unit 7 can be composed of a computer program (a noise reduction program). The reference signal storage unit 7 may be provided as an external storage unit separate from the noise reduction device.

Figure 8:
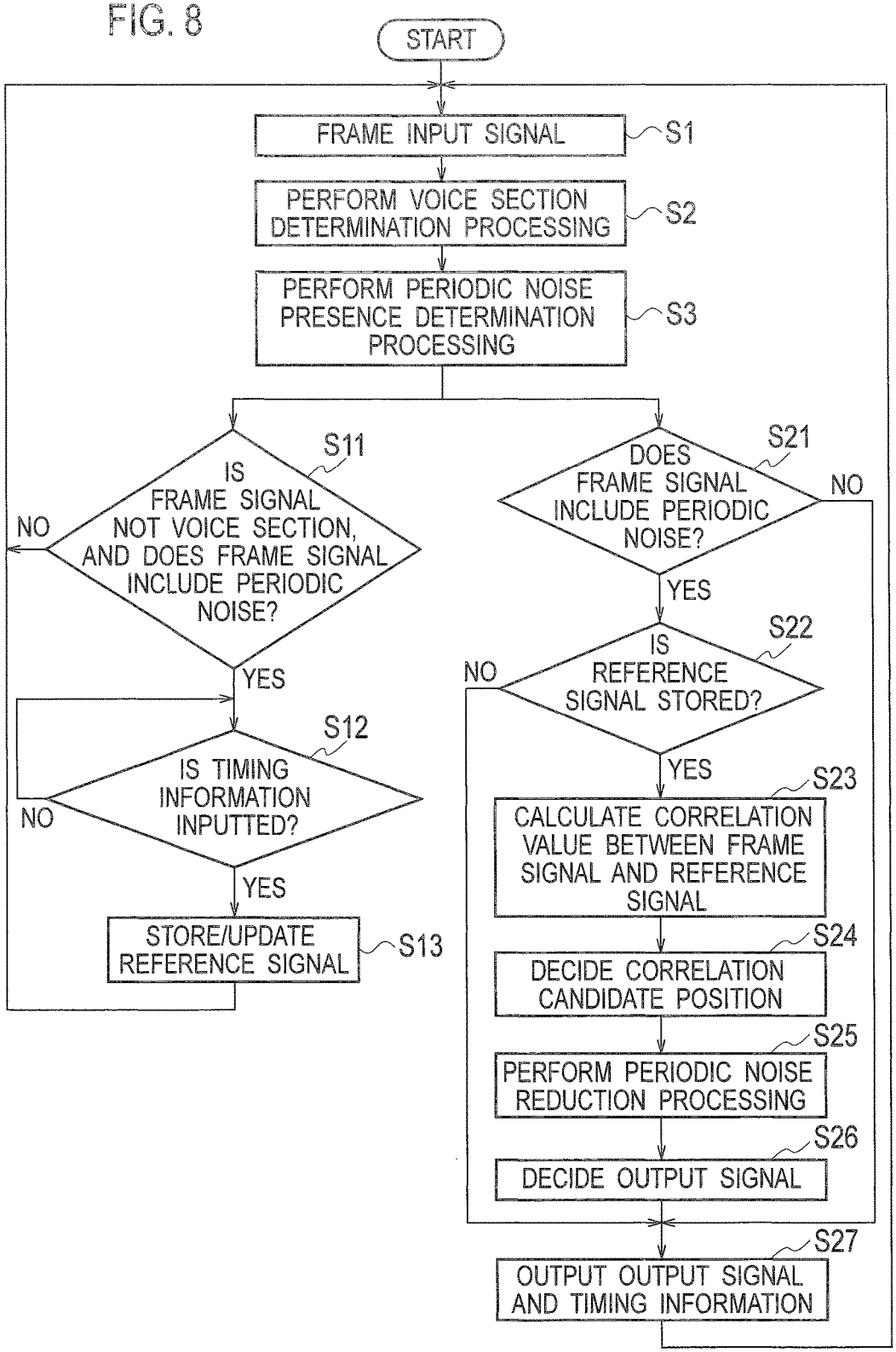
FIG. 8 is a flowchart for describing the operations of the noise reduction device according to the embodiment, a procedure of a noise reduction method according to the embodiment, and processing executed by a noise reduction program according to the embodiment.

Next, by using the flowchart shown in FIG. 8, a further description is made of the operations of the noise reduction device according to the embodiment, a procedure of the noise reduction method according to the embodiment, and the processing executed by the noise reduction program according to the embodiment.

In step S1 of FIG. 8, the frame generator 3 frames the input signal Sig2, and generates the frame signal Sig3.

In step S2, the voice section determiner 4 determines whether or not the frame signal Sig3 is the voice section including the voice signal. In step S3, the periodic noise determiner 5 determines whether or not the frame signal Sig3 includes the periodic noise signal. An order of step S2 and step S3 may be inverted, or step S2 and step S3 may be performed simultaneously.

Step S11 to step S13 show processing for storing the reference signal Sig7 in the reference signal storage unit 7, by the reference signal update controller 6 or processing for updating the reference signal Sig7, which is stored in the reference signal storage unit 7 by the reference signal update controller 6.

In step S11, the reference signal update controller 6 determines whether or not the frame signal Sig3 is the voice section, and includes the periodic noise signal as a result of such determination processing in each of steps S2 and S3.

If the frame signal Sig3 is not the voice section and includes the periodic noise signal (YES), then in step S12, the reference signal update controller 6 determines whether or not the timing information Sig111 is inputted. If the timing information Sig111 is not inputted to the reference signal update controller 6 (NO), then the reference signal update controller 6 repeats the processing of step S12.

If the timing information Sig111 is inputted to the reference signal update controller 6 (YES), then in step S13, the reference signal update controller 6 allows the reference signal storage unit 7 to store the reference signal Sig7 therein. If the reference signal Sig7 is already stored in the reference signal storage unit 7, then the reference signal Sig7 is updated.

After step S13 the processing is returned to step S1, and the processing of steps S1 to S3 and S11 to S13 is repeated.

In step S11, if the frame signal Sig3 is not the voice section, or alternatively, if it does not include the periodic noise signal (NO), then the processing for storing or updating the reference signal Sig7 is not executed. Accordingly, the processing is returned to step S1, and the processing of steps S1 to S13 is repeated.

Steps S21 to S27 show the reduction processing for reducing the periodic noise signal from the frame signal Sig3 by the correlation value calculator 8 to the output signal decider 11.

In step S21, the correlation value calculator 8 determines whether or not the frame signal Sig3 includes the periodic noise signal. If the frame signal Sig3 includes the periodic noise signal (YES), then in step S22, the correlation value calculator 8 determines whether or not the reference signal Sig7 is stored in the reference signal storage unit 7.

If the reference signal Sig7 is stored (YES), then in step S23, the correlation value calculator 8 calculates the correlation value between the frame signal Sig3 and the reference signal Sig7. In step S24, the correlation candidate position decider 9 decides the correlation candidate position based on the correlation value signal Sig8.

In step S25, the noise reduction processor 10 performs the processing so as to reduce the periodic noise signal, which is included in the frame signal Sig3, based on the position information Sig9, indicating each of the plurality of correlation candidate positions.

In step S26, from among the plurality of candidate output signals Sig10, the output signal decider 11 decides the candidate output signal Sig10, in which the periodic noise signal is reduced the most, as such a final output signal Sig11. In step S27, the output signal decider 11 outputs the output signal Sig11 and the timing information Sig111.

If the frame signal Sig3 does not include the periodic noise signal in step S21 (NO), then it is not necessary to execute the reduction processing for the periodic noise signal, and accordingly, the processing proceeds to step S27.

Moreover, if the reference signal Sig7 is not stored in the reference signal storage unit 7 in step S22 (NO), then the reduction processing for the periodic noise signal cannot be executed, and accordingly, the processing proceeds to step S27 in a similar way.

At this time, the noise reduction processor 10 directly supplies the frame signal Sig3, which is inputted thereto to the output signal decider 11, and in step S27, the output signal decider 11 outputs the frame signal Sig3 and the timing information Sig111.

After step S27, the processing is returned to step S1, and the processing of steps S1 to S3 and S21 to S27 is repeated.

Note that the noise reduction program needs only to allow a computer to execute the processing of the respective steps described above. The noise reduction program may be recorded in a non-transitory recording medium, or may be transmitted through an electric communication line.

As described above, in accordance with the noise reduction method and the noise reduction program according to the embodiment, the periodic noise signal can be reduced effectively even when the frequency change of the periodic noise is relatively fast.

Here, a description is made of the reason why. In a case of the periodic noise in which the frequency change is relatively fast, there cannot be adopted the method of converting the input signal into a signal within the frequency range, detecting the periodic noise, and suppressing the periodic noise signal as in the noise reduction device described in Patent Literature 1.

Figure 9A:
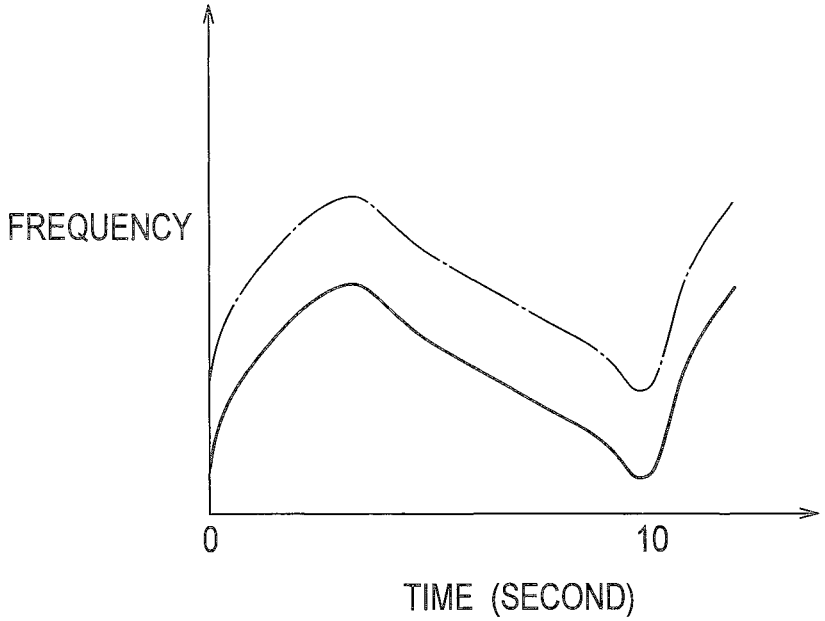
FIG. 9A is a characteristic diagram showing a periodic noise signal in which frequency change is relatively slow.

FIG. 9A shows a periodic noise signal in which a frequency change is slower than that of the periodic noise signal, as shown in FIG. 3. In FIG. 9A, a solid line shows a fundamental wave component of the periodic noise signal, and an alternating long and short dash line shows a harmonic component thereof. When this periodic noise signal is converted into a signal within the frequency range, such a waveform is obtained, as shown in FIG. 9B.

Figure 9B:
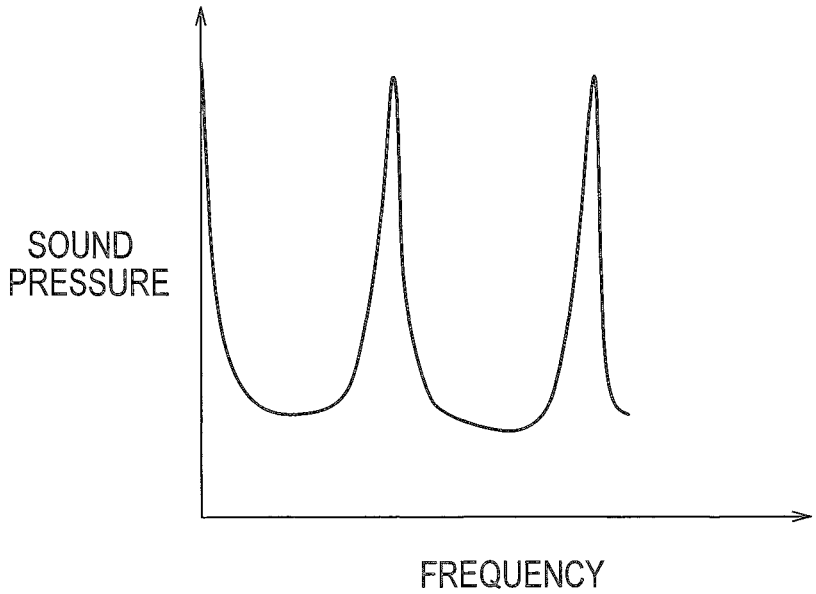
FIG. 9B is a characteristic diagram showing a signal obtained by converting the periodic noise signal as shown in FIG. 9A into a frequency range.

When a periodic noise signal in which the frequency change is relatively slow is converted into a signal within the frequency range, then as shown in FIG. 9B, peaks of the frequency appear clearly. Hence, frequency components in which the peaks appear are attenuated, thus making it possible to suppress the periodic noise signal.

Figure 10A:
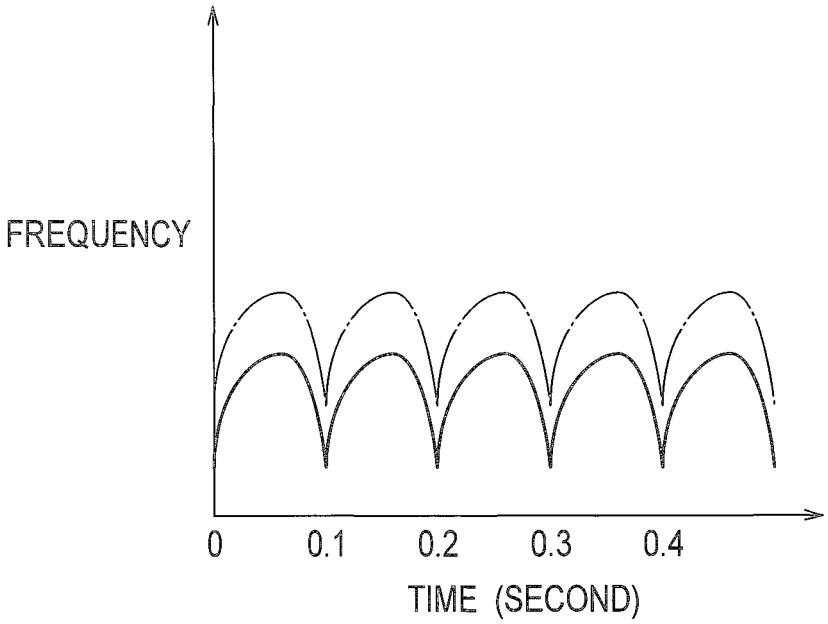
FIG. 10A is a characteristic diagram showing a periodic noise signal in which frequency change is relatively fast.

FIG. 10A shows a periodic noise signal in which the frequency change is relatively fast in a similar way to FIG. 3. In FIG. 10A, a solid line shows a fundamental wave component of the periodic noise signal, and an alternating long and short dash line shows a harmonic component thereof. When this periodic noise signal is converted into the signal within the frequency range, such a waveform is obtained, as shown in FIG. 10B.

Figure 10B:
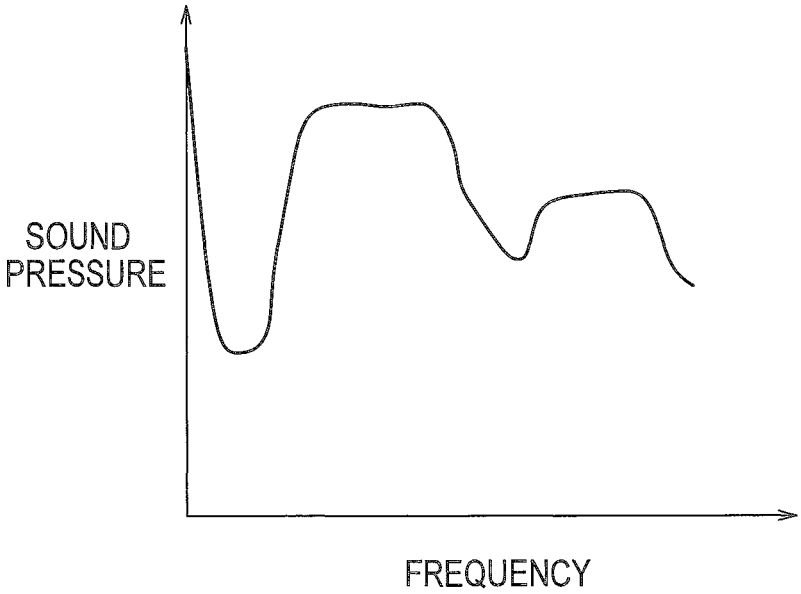
FIG. 10B is a characteristic diagram showing a signal obtained by converting the periodic noise signal shown in FIG. 10A into a frequency range.

When a periodic noise signal in which the frequency change is relatively fast is converted into a signal within the frequency range, then as shown in FIG. 10B, the peaks of the frequency do not appear clearly. Hence, it is not possible to adopt the method of suppressing the periodic noise signal by attenuating the frequency components in which the peaks appear.

In accordance with the noise reduction device, the noise reduction method and the noise reduction program according to the embodiment, the periodic noise signal can be reduced effectively even in the case where such a configuration in which the input signal is converted into a signal within the frequency range is not adopted, and the input signal includes the periodic noise signal as shown in FIG. 10A, in which the frequency range is relatively fast.

As a matter of course, in accordance with the noise reduction device, the noise reduction method and the noise reduction program according to the embodiment, the periodic noise signal can be reduced effectively even in the case where the input signal includes the periodic noise signal as shown in FIG. 9A, in which the frequency range is relatively slow.

That is, the noise reduction device, the noise reduction method, and the noise reduction program according to the embodiment exert the effect of reducing the periodic noise irrespective of the speed of the frequency change of the periodic noise signal. It is preferable that the frame generator 3 should generate the frame signal Sig3 with a time length corresponding to the cycle of the periodic noise signal. It is preferable that the frame generator 3 should have a configuration capable of selecting the time length of the frame signal Sig3, in response to the cycle of the periodic noise signal.

The present invention is not limited to the embodiment described above, and is changeable in various ways within the scope without departing from the scope of the present invention.

The configuration shown in FIG. 1 is made so as to appropriately update the reference signal Sig7, which the reference signal storage unit 7 is allowed to store therein by the reference signal update controller 6. Such a configuration may also be adopted in which the reference signal Sig7 is not updated, but the reference signal storage unit 7 stores a fixed reference signal Sig7. In this case, it is possible to omit the reference signal update controller 6.

In the configuration of updating the reference signal Sig7, the reference signal Sig7, corresponding to the change of the periodic noise signal, can be achieved, and accordingly, the periodic noise signal can be reduced more effectively. Hence, the configuration of updating the reference signal Sig7 is preferable.

What is claimed is:

1. A noise reduction device comprising:

a frame generator configured to frame an input audio signal per predetermined number of samples, and to sequentially generate audio frame signals;

a reference signal storage unit configured to store therein a reference audio signal having a time length longer than a time length of each of the audio frame signals, the reference audio signal showing a periodic noise signal mixed with the input audio signal;

a correlation value calculator configured to calculate correlation values between the audio frame signals and the reference audio signal;

a correlation candidate position decider configured to select a plurality of locations in which the correlation values are relatively high, and to decide a plurality of correlation candidate positions serving as candidates for a signal portion of the reference audio signal correlated with the audio frame signals;

a noise reduction processor configured to perform processing to reduce the periodic noise signal, which is included in the audio frame signal, by using each signal portion of the plurality of correlation candidate positions, and to generate a plurality of candidate output audio signals which are candidates for an output audio signal subjected to noise reduction processing; and an output signal decider configured to decide a candidate output audio signal, in which the periodic noise signal is reduced the most among the plurality of candidate output audio signals, as the output audio signal, and to output the decided output audio signal.

2. The noise reduction device according to claim 1, further comprising:

a voice section determiner configured to determine whether or not each of the audio frame signals generated by the frame generator is a voice section including a voice signal; and a periodic noise determiner configured to determine whether or not each of the audio frame signals includes the periodic noise signal, wherein the reference signal storage unit stores therein a reference audio signal that is based on a plurality of audio frame signals which are determined not to be the voice sections by the voice section determiner and are determined to include the periodic noise signals by the periodic noise determiner.

3. The noise reduction device according to claim 2, further comprising a reference signal update controller configured to perform a control to update the reference audio signal, which is stored in the reference signal storage unit when the audio frame signals are determined not to be the voice sections by the voice section determiner and are determined to include the periodic noise signals by the periodic noise determiner.

4. The noise reduction device according to claim 1, wherein the output signal determiner selects a one of said audio frame signals, in which the periodic noise signal is determined to be reduced the most, by using at least one of each of square sum signals of the plurality of audio frame signals subjected to the noise reduction processing and a value indicating a variance of an amplitude.

5. A noise reduction method comprising the steps of:

framing an input audio signal per a predetermined number of samples and sequentially generating audio frame signals;

calculating correlation values between the audio frame signals and a reference audio signal having a time length longer than a time length of each of the audio frame signals, the reference audio signal showing a periodic noise signal mixed with the input audio signal;

selecting a plurality of locations in which the correlation values are relatively high, and deciding a plurality of correlation candidate positions serving as candidates for a signal portion of the reference audio signal correlated with the audio frame signals;

performing processing to reduce the periodic noise signal, which is included in the audio frame signal, by using each signal portion of the plurality of correlation candidate positions, and generating a plurality of candidate output signals, which are candidates for an output audio signal subjected to noise reduction processing; and selecting a candidate output signal, in which the periodic noise signal is reduced the most among the plurality of candidate output signals, and outputting the selected candidate output signal as the output audio signal.

6. A computer software product that includes a non-transitory storage medium readable by a processor, the non-transitory storage medium having stored thereon a set of instructions for performing noise reduction, the instructions comprising:

(a) a first set of instructions which, when loaded into main memory and executed by the processor, causes the processor to frame an input audio signal per a predetermined number of samples and sequentially generating audio frame signals;

(b) a second set of instructions which, when loaded into main memory and executed by the processor, causes the processor to calculate correlation values between the audio frame signals and a reference audio signal having a time length longer than a time length of each of the audio frame signals, the reference audio signal showing a periodic noise signal mixed with the input audio signal;

(c) a third set of instructions which, when loaded into main memory and executed by the processor, causes the processor to select a plurality of locations in which the correlation values are relatively high, and deciding a plurality of correlation candidate positions serving as candidates for a signal portion of the reference audio signal correlated with the audio frame signals;

(d) a fourth set of instructions which, when loaded into main memory and executed by the processor, causes the processor to perform processing to reduce the periodic noise signal, which is included in the audio frame signal, by using each signal portion of the plurality of correlation candidate positions, and generating a plurality of candidate output signals which are candidates for an output audio signal subjected to noise reduction processing; and (f) a fifth set of instructions which, when loaded into main memory and executed by the processor, causes the processor to select a candidate output signal, in which the periodic noise signal is reduced the most among the plurality of candidate output signals, as the output audio signal.

* * * * *